US008337693B2

(12) United States Patent
Mitchell

(10) Patent No.: US 8,337,693 B2
(45) Date of Patent: Dec. 25, 2012

(54) ENHANCED FILTER INDICATIOR FOR REFRIGERATOR

(75) Inventor: Alan Joseph Mitchell, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1333 days.

(21) Appl. No.: 11/373,342

(22) Filed: Mar. 10, 2006

(65) Prior Publication Data

US 2007/0209978 A1 Sep. 13, 2007

(51) Int. Cl.
*B01D 35/14* (2006.01)
*B01D 35/00* (2006.01)

(52) U.S. Cl. ..... 210/85; 210/138; 96/417; 96/418; 96/424; 116/DIG. 25; 62/129

(58) Field of Classification Search ..... 210/85, 210/94, 138; 96/417, 418, 424, 425; 116/DIG. 25, 116/DIG. 42; 62/129
See application file for complete search history.

(56) References Cited

U.S. PATENT DOCUMENTS

| | | | | |
|---|---|---|---|---|
| 2,190,123 | A * | 2/1940 | Pace | 362/503 |
| 3,794,168 | A | 2/1974 | Perkins | 210/90 |
| 4,336,038 | A | 6/1982 | Schultheiss et al. | 55/274 |
| 4,818,385 | A | 4/1989 | Medley, III | 210/90 |
| 5,128,034 | A | 7/1992 | Kool | 210/232 |
| 6,214,239 | B1 | 4/2001 | Renau | 210/739 |
| 6,306,290 | B1 * | 10/2001 | Rolfes | 210/85 |
| 6,375,834 | B1 * | 4/2002 | Guess et al. | 210/85 |
| 6,497,756 | B1 | 12/2002 | Curado et al. | 96/117.5 |
| 6,572,233 | B1 * | 6/2003 | Northman et al. | 359/839 |
| 6,610,198 | B1 | 8/2003 | Jiang et al. | 210/86 |
| 6,811,691 | B2 | 11/2004 | Woodard, Jr. et al. | 210/232 |
| 6,848,817 | B2 * | 2/2005 | Bos et al. | 362/494 |
| 6,918,259 | B2 | 7/2005 | Anderson et al. | 62/78 |
| 2003/0010721 | A1 * | 1/2003 | Aldred et al. | 210/694 |
| 2003/0178356 | A1 | 9/2003 | Bartkus et al. | 210/232 |
| 2004/0055948 | A1 * | 3/2004 | Blum et al. | 210/435 |
| 2004/0083896 | A1 | 5/2004 | Mihaylov et al. | 96/414 |
| 2004/0155466 | A1 * | 8/2004 | Sodemann et al. | 290/1 A |

* cited by examiner

*Primary Examiner* — Nam Nguyen
*Assistant Examiner* — Madeline Gonzalez
(74) *Attorney, Agent, or Firm* — Kirk W. Goodwin; Greer, Burns & Crain

(57) ABSTRACT

An indicator for a refrigerator filter which has a body configured to contain a replaceable filter cartridge and including an openable cap to enclose the filter cartridge within the body. The indicator includes a control having a filter life determination mechanism and arranged to emit a signal when a life of the filter cartridge is determined to be expired. A visual display is arranged in association with the body which comprises an illuminating component which illuminates upon receipt of the signal from the control, graphics positioned in association with the body, and a light pipe extending from the graphics towards the illuminating component to transmit light from the illuminating component to the graphics.

23 Claims, 3 Drawing Sheets

ENHANCED FILTER INDICATIOR FOR REFRIGERATOR

BACKGROUND OF THE INVENTION

The present invention relates generally to a filter indicator for a refrigerator.

Filters, such as water filters, are commonly used on refrigerator/freezer products to remind consumers to order or replace the filter. An electronic display may be located on the control box or door of the refrigerator. The indicator can be a series of colored LEDs. Graphics displayed to the side of the LEDs instruct the user on what needs to be done. An indicator of this type is disclosed in U.S. Pat. No. 6,613,036. Another type of indicator is a two digit seven segment display. The display shows the percent of life remaining for the filter. When the display reaches zero, the user is supposed to replace the filter. The user does not associate the indicator with the filter and the placement of the filter is usually distant from the location of the display, and the user may not be familiar with the placement of the filter, and oftentimes ignores the replacement indicator. Controls located on the control box or door are commonly associated with temperature adjustment, so the user does not associate the indicator with the filter, or its need for replacement. The graphic instructions are unhighlighted text that is easy to ignore.

Some filters are provided with illuminated indicators at or near the filter location, such as those disclosed in U.S. Pat. Nos. 3,794,168, 5,128,034 and 6,214,239, however these indicators are limited to one or more LEDs which provide only a color indicator to the user, and provide a visual indication that is very small in size and easy to overlook or misunderstand.

There are other, non-illuminated, filter indicators that may provide an indication to the user that the condition of the filter has changed including color changing indicators, such as disclosed in U.S. Pat. Nos. 6,346,143, 6,497,756 and 6,610,198, or with indicators that change position, such as disclosed in U.S. Pat. No. 4,818,385. Some non-illuminated filter indicators use a change in color of a treated area which is configured to spell out a specific instruction to the user, such as disclosed in U.S. Pat. No. 4,336,038 and U.S. Patent Application Publication US2004/0083896. The lack of illumination of these indicators may reduce the likelihood that the indicator is actually observed by the user.

It would be an improvement in the art if an illuminated indicator were provided for a refrigerator filter that would provide, at or near the location of the filter, a highly visible and instructive indication to the user that the filter required replacement. If the user were provided with a more intuitive indicator, and one that is located at or near the filter location, replacement rates may be improved, resulting in an improved operation of the refrigerator.

SUMMARY OF THE INVENTION

The present invention, in an embodiment, provides an indicator for a refrigerator filter which has a body configured to contain a replaceable filter cartridge and including an openable cap to enclose the filter cartridge within the body. The indicator includes a control having a filter life determination mechanism and arranged to emit a signal when a life of the filter cartridge is determined to be expired. A visual display is arranged in association with the body which comprises an illuminating component which illuminates upon receipt of the signal from the control, graphics positioned in association with the body, and a light pipe extending from the graphics towards the illuminating component to transmit light from the illuminating component to the graphics.

In an embodiment, the illuminating component comprises an LED.

In an embodiment, the graphics comprise a written instruction to a user to replace the filter cartridge.

In an embodiment, the cap is a co-injected molded plastic part, with one plastic material being light transmissive.

In an embodiment, the indicator includes a second visual display operated by the control providing a user with an indication of the remaining life of the filter cartridge.

In an embodiment, the control includes an electronics mechanism for determining a remaining life for the filter cartridge.

In an embodiment, the visual display is powered by a battery.

In an embodiment, the control is located on the body.

In an embodiment, the filter cartridge is a water filter.

In an embodiment, the filter cartridge is an air filter.

The present invention, in an embodiment, provides an indicator for a refrigerator filter having a body configured to contain a replaceable filter cartridge and including a removable cap to enclose the filter cartridge within the body. The indicator includes a control having a filter life determination mechanism which is arranged to emit a signal when a life of the filter cartridge is determined to be expired. The indicator further has a visual display arranged on the body, an LED mounted on the body which is illuminated upon receipt of the signal from the control and a light pipe extending from the cap towards the LED to transmit light from the LED to an exterior surface of the cap, and graphics arranged on the cap illuminated by the illuminating component via the light pipe which graphics are visible from the exterior surface of the cap. The cap comprises a pair of co-injected molded plastic parts, with the light pipe being one of the plastic parts being co-injected and an opaque plastic part being another of the plastic parts being co-injected.

The present invention, in an embodiment, provides a refrigerator including a filter indicator including a cabinet and a body mounted in the cabinet configured to contain a replaceable filter cartridge and including an openable cap to enclose the filter cartridge within the body. The refrigerator further includes a control having a filter life determination mechanism which is arranged to emit a signal when a life of the filter cartridge is determined to be expired and a visual display associated with the body which comprises an illuminating component which illuminates upon receipt of the signal from the control, graphics positioned in association with the body, and a light pipe extending from the graphics towards the illuminating component to transmit light from the illuminating component to the graphics.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figure 1:
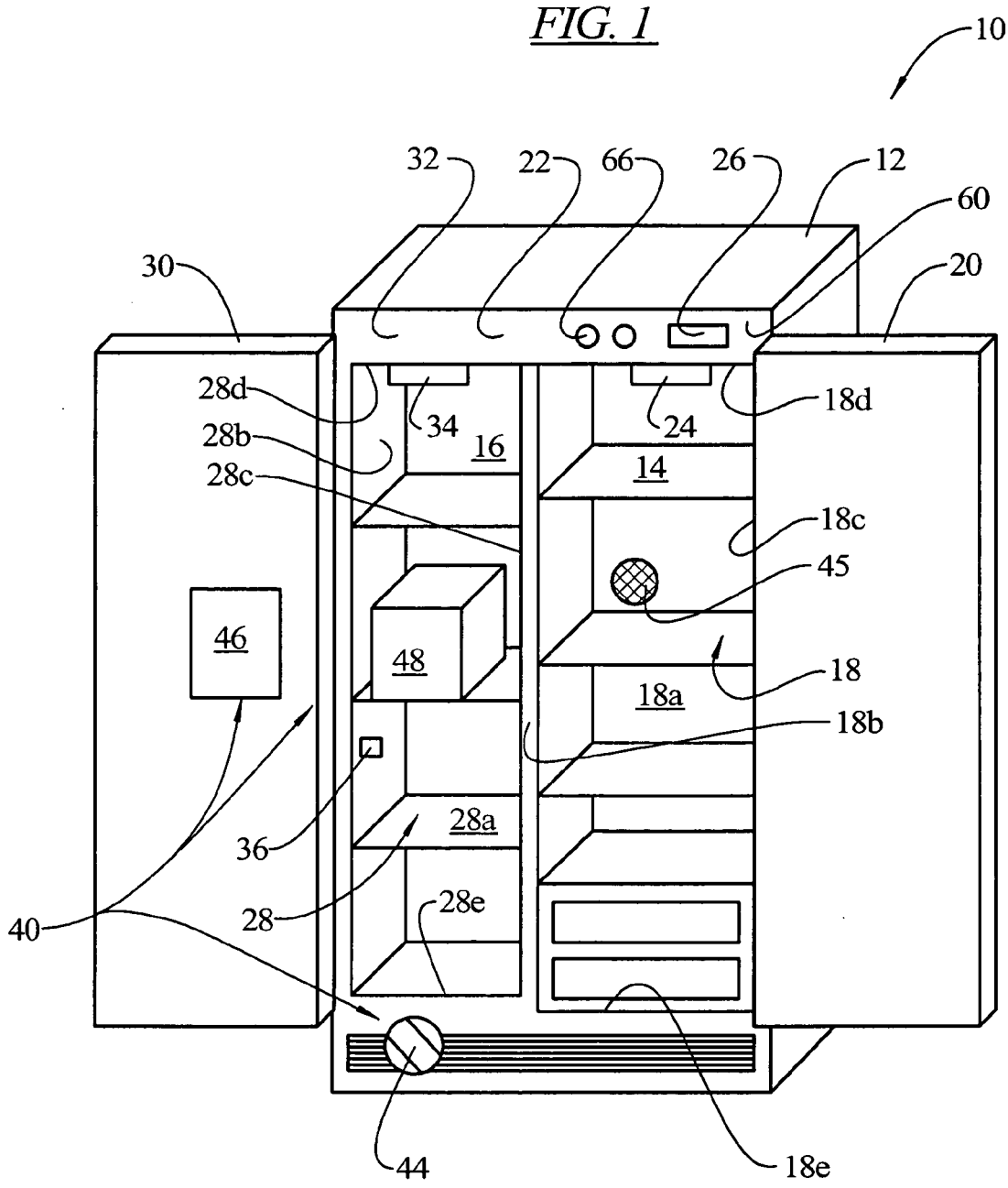
FIG. 1 is a front perspective view of a refrigerator cabinet, with the doors opened for clarity.

In the illustrative embodiment of the invention as shown in FIG. 1, a refrigerator 10, comprising a side-by-side fresh food/freezer configuration, is provided having a cabinet 12 forming fresh food compartment 14 and freezer compartment 16.

The fresh food compartment 14 is provided with an access opening 18 and a fresh food door 20 hingedly mounted to the cabinet 12 for selectively closing the access opening 18. The access opening 18 has a back wall 18*a*, side walls 18*b* and 18*c*, top wall 18*d*, and a bottom wall 18*e*. The refrigerator 10 also has a partial front wall 22 disposed around the perimeter of the access opening 18 parallel to and selectively engageable with the fresh food door 20 for sealing the access opening 18.

The fresh food compartment 14 is further provided with a light 24 which is connected in series with a light switch 26. The light switch 26 is a reciprocable switch actuated to selectively connect the light 24 with a source of electrical power, not shown, when the door 20 is in an open position and to disconnect the light 24 from the source of electrical power when the fresh food door 20 is in the closed position. In the preferred embodiment, the light switch is located in portion of the partial front wall 22 above the top wall 18*d* of the access opening.

Similarly, the freezer compartment 16 is provided with an access opening 28 and a freezer door 30 hingedly mounted to the cabinet 12 for selectively closing the access opening 28. The access opening 28 has a back wall 28*a*, side walls 28*b* and 28*c*, top wall 28*d*, and a bottom wall 28*e*. The refrigerator 10 also has a partial front wall 32 disposed around the perimeter of the access opening 28 parallel to and selectively engageable with the freezer door 30 for sealing the access opening 28. The freezer compartment 14 is further provided with a light 34 which is connected in series with a light switch 36 functionally similar to the light 24 and light switch 36 in the fresh food compartment 14.

As is further well known in the art, the refrigerator 10 is provided with a water and ice supply system 40 for delivering water from an external source through a water filter 44 mounted in the cabinet 12 to an ice and water delivery system 46. The refrigerator may also, or alternatively be provided with an air circulating system in which an air filter 45 mounted in the cabinet is arranged to remove undesired particulates from an air stream directed through the filter.

As shown in FIG. 1, and in greater detail in FIG. 2, the water filter 44 may be mounted to the refrigerator cabinet 12 below the bottom wall 28*e* of the access opening 28 and accessed for servicing by selective removal through an opening 47 through the lowermost portion of the partial front wall 32.

The ice and water delivery system 46 may include an ice making assembly 48 mounted within the freezer compartment 16 and an ice and water dispensing system mounted in the freezer door 30. In some refrigerators, only a water dispensing system may be provided, while in other refrigerators, only an ice dispensing system may be provided.

In an embodiment of the present invention, a refrigerator control console 60 is defined on an upper portion of the partial front wall 22 of the fresh food compartment 16 in the vicinity of the light switch 26. The refrigerator control console 60, which is shown integral with the front wall 22, includes a fresh food compartment temperature control switch 62, a freezer compartment temperature control switch 64, the light switch 26. In the vicinity of the light switch 26, the refrigerator control console 60 may include a filtration system status indicator 66, described below.

Figure 2:
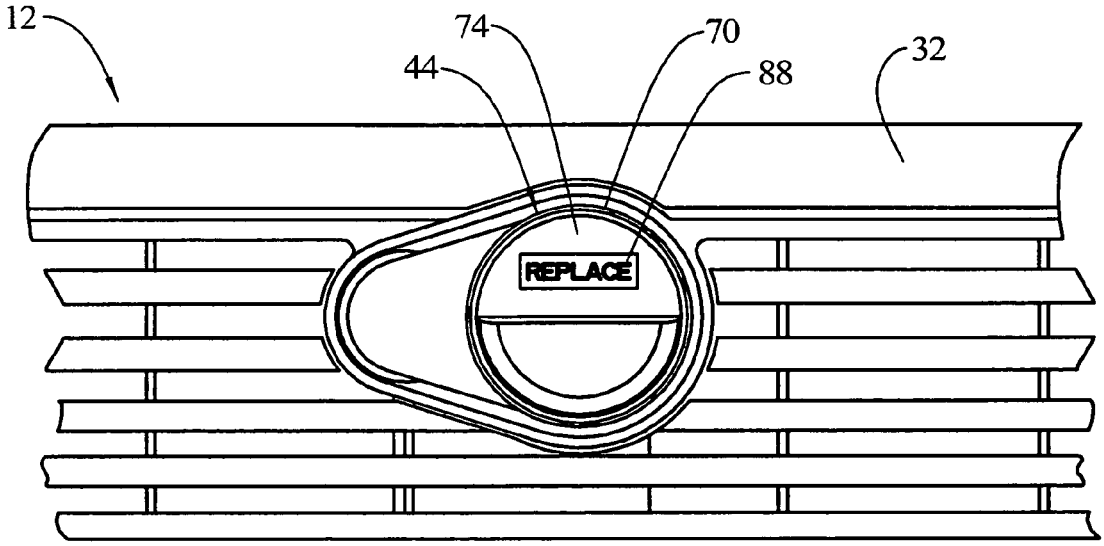
FIG. 2 is an enlarged elevational view of one of the filters in the cabinet as shown in FIG. 1.
Figure 3:
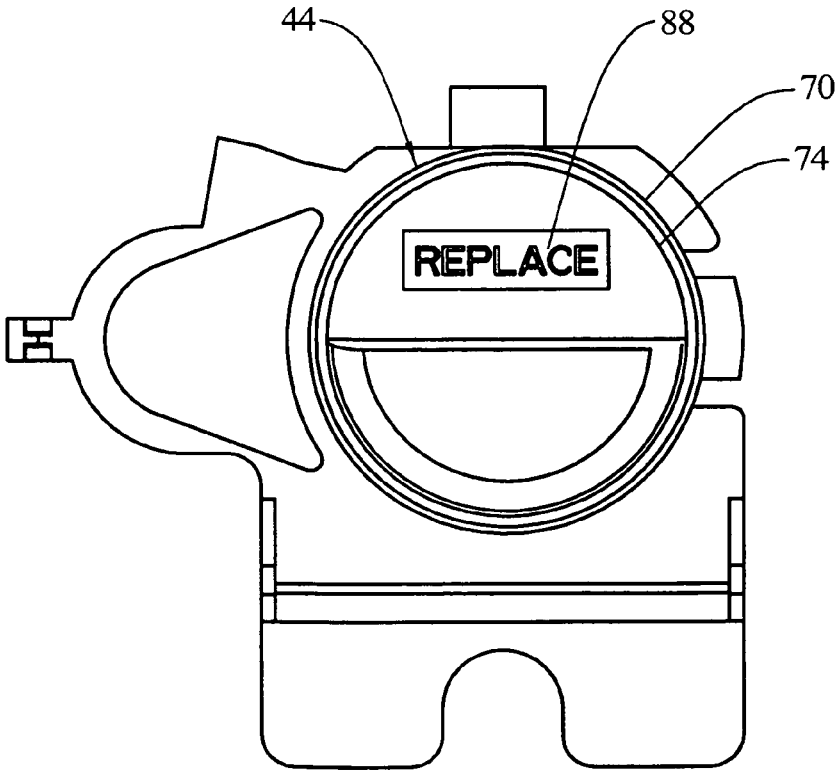
FIG. 3 is a front elevational view of the filter of FIG. 2.
Figure 4:
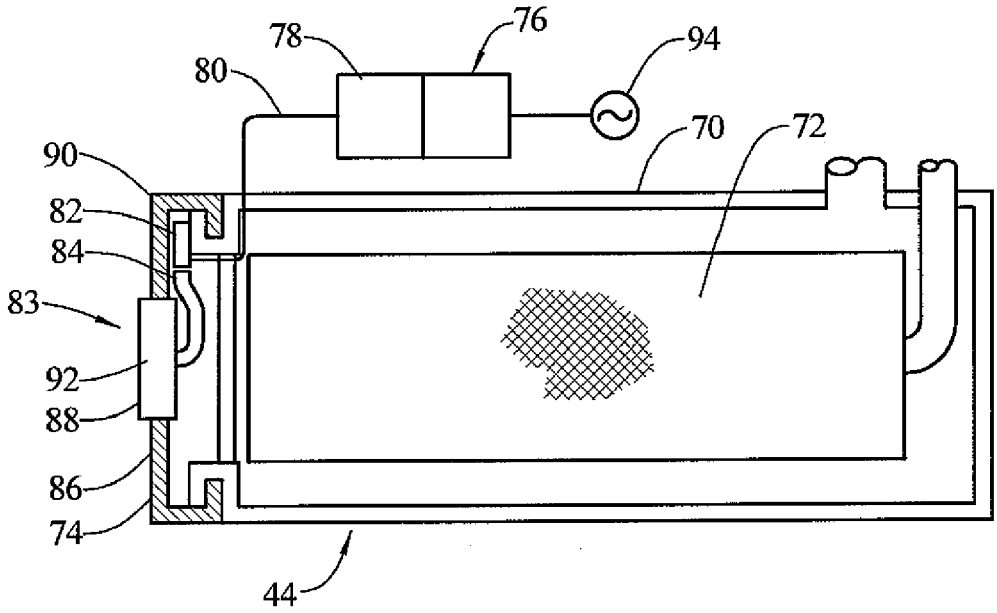
FIG. 4 is a schematic side sectional view of the water filter of FIG. 2.

As illustrated in FIGS. 2-4, one embodiment of the water filter 44 comprises a body or housing 70 mounted in the cabinet 12 configured to contain a replaceable filter cartridge 72 and including an openable cap 74 to enclose the filter cartridge within the body. The filter cartridge 72 may comprise any type of filter medium designed to remove undesired contaminant particles from the fluid passing through the filter cartridge. The filter cartridge 72 may be a simple filter material insertable into the body 70 or may include various passages, seals, filter materials, housing elements and other structures that are removed and replaced each time the filter cartridge is changed.

The cap 74 may be completely removable from the remainder of the body 70, or it may remain attached to the remainder of the body when in the open position. If completely removable, the cap 74 may attach to the remainder of the body 70 such as with a bayonet mount, a threaded connection, a snap or detent connection, or other attachment arrangements. In arrangements where the cap 74 is not removable, it may hinge or pivot to an open position relative to the remainder of the body 70.

A control 76 is provided which has a filter life determination mechanism 78, for example, such as that disclosed in U.S. Pat. No. 6,613,236, the disclosure of which is incorporated herein by reference. The filter life determination mechanism 78 may calculate a remaining life for the filter cartridge 72 based upon time in service, volume of flow of fluid through the filter cartridge, or a combination of these approaches. The control 76 is arranged to emit a signal when a life of the filter cartridge is determined to be expired. This signal may be transmitted through a wire 80 or other conductive arrangement, or by a wireless transmission arrangement. An illuminating component 82, such as an LED, an incandescent bulb or similar illuminating device, is provided in association with the body 70 and illuminates upon receipt of the signal from the control 76 as part of an indicator 83 for the refrigerator filter 44. The illuminating component 82 may be mounted directly on the body 70 or may be located remote from the body. A light pipe 84, which may be any arrangement for transmitting light from the illuminating component 82, extends from the cap 74 towards the illuminating component 82 to transmit light from the illuminating component to an exterior surface 86 of the cap. The light pipe 84 may be a transparent or translucent plastic or glass material which is configured to allow the illumination from the illuminating component 82 to be directed to a particular location on the cap 74 through a path which is straight or other than a straight line. In other embodiments, the light pipe 84 may merely be a passage for the light to travel from the illuminating component 82 to the cap 74 without bending or changing direction.

The cap 74 includes graphics 88 at the outer surface 86 that are illuminated by the illuminating component 82 via the light pipe 84 and are visible from the exterior surface 86 of the cap 74. For example, the graphics 88 may comprise a written instruction to a user to replace the filter cartridge 72, such as the word "REPLACE." The graphics 88 may also comprise a picture, icon or symbol indicating to the user that the filter cartridge 72 should be replaced. The graphics 88 may be located adjacent to the body 70 rather than being located directly on the cap 74 in some arrangements, but the graphics should be located in close association with the filter 44 so that the user's attention is directed to the location of the filter when the graphics are illuminated. The term graphics, as used herein, is meant to mean something other than the illumination source itself.

The illumination from the illuminating component 82 may be directed to an outer surface of the graphics 88, or the graphics may be light transmissive so that the illumination can be directed to a back side of the graphics, and transmitted therethrough to the exterior surface 86 of the cap 74.

In an embodiment, the cap may comprise a pair of co-injected molded plastic parts 90, 92, with the light pipe 84 being a light transmissive one of the plastic parts being co-injected and an opaque plastic part being another of the plastic parts being co-injected.

The control 76 may be mounted remotely from the filter 44, such as at the control console 60, or the control may be mounted directly on the filter body 70. In an embodiment, the control 76 includes an electronics mechanism for determining a remaining life for the filter cartridge. The control 76 and the illuminating component 82 may be powered by a domestic AC power supply 94, such as that used to power the refrigerator 10, or the control or the illuminating component may be powered by a battery to avoid the necessity of running power lines to these components.

In an embodiment, the indicator 83 includes a second visual display, such as the filtration system status indicator 66 mentioned above, which may also be operated by the control 76 providing a user with an indication of the remaining life of the filter cartridge. For example, the status indicator 66 may show a percentage of life remaining for the filter 44, or may show an approximate amount of time remaining in the useful life of the filter. Thus, the user would be provided with an advance warning by the status indicator 66, and a notice to immediately change the filter by the illumination at the outer surface of the body, such as by the illumination of the graphics 88.

Figure 5:
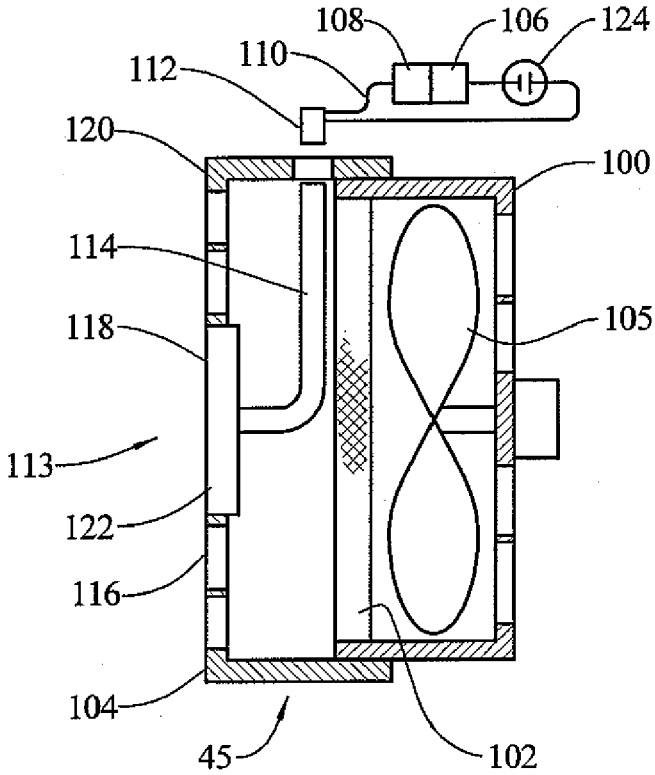
FIG. 5 is a side sectional view of the air filter of FIG. 1.

Another embodiment of the invention is illustrated in FIG. 5, in which the air filter 45 communicates with the air inside of the fresh food compartment 14 and/or the freezer compartment 16. The filter 45 comprises a body or housing 100 mounted in the cabinet 12 configured to contain a replaceable filter cartridge 102 and including an openable cap 104 to enclose the filter cartridge within the body. The filter cartridge 102 may comprise any type of filter medium designed to remove undesired contaminant particles from the fluid passing through the filter cartridge. An air moving device 105, such as a fan, may be used to direct an air stream through the filter cartridge 102, or the air may flow through the filter through natural convection currents. The filter cartridge 102 may be a simple filter material insertable into the body 100 or may include various passages, seals, filter materials, housing elements and other structures that are removed and replaced each time the filter cartridge is changed. The cap 104 may be completely removable from the remainder of the body 100, or it may remain attached to the remainder of the body when in the open position. If completely removable, the cap 104 may attach to the remainder of the body 100 such as with a bayonet mount, a threaded connection, a snap or detent connection, or other attachment arrangements. In arrangements where the cap 104 is not removable, it may hinge or pivot to an open position relative to the remainder of the body 100.

A control 106 is provided which has a filter life determination mechanism 108, for example, such as that disclosed in U.S. Pat. No. 6,613,236, the disclosure of which is incorporated herein by reference. The filter life determination mechanism 108 may calculate a remaining life for the filter cartridge 102 based upon time in service, volume of flow of fluid through the filter cartridge, or a combination of these approaches. The control 106 is arranged to emit a signal when a life of the filter cartridge 102 is determined to be expired. This signal may be transmitted through a wire 110 or other conductive arrangement, or by a wireless transmission arrangement. An illuminating component 112, such as an LED, an incandescent bulb or similar illuminating device, may be mounted on or near the body 100 and illuminates upon receipt of the signal from the control 106 as part of an indicator 113 for the refrigerator air filter 45. The illuminating component 112 may be mounted directly on the body 100 or may be located remote from the body, such as above the body, and secured directly to the refrigerator as shown in FIG. 5. A light pipe 114, which may be any arrangement for transmitting light from the illuminating component 112, extends from the cap 104 towards the illuminating component 112 to transmit light from the illuminating component to an exterior surface 116 of the cap. The light pipe 114 may be a transparent or translucent plastic or glass material which is configured to allow the illumination from the illuminating component 112 to be directed to a particular location on the cap 104 through a path which is straight or other than a straight line. In other embodiments, the light pipe 114 may merely be a passage for the light to travel from the illuminating component 112 to the cap 104 without bending or changing direction.

The cap 104 includes graphics 118 at the outer surface 116 that are illuminated by the illuminating component 112 via the light pipe 114 and are visible from the exterior surface 116 of the cap 104. For example, the graphics 118 may comprise a written instruction to a user to replace the filter cartridge 102, such as the word "REPLACE." The graphics 118 may also comprise a picture, icon or symbol indicating to the user that the filter cartridge 102 should be replaced. The graphics 118 may be located adjacent to the body 100 rather than being located directly on the cap 104 in some arrangements, but the graphics should be located in close association with the filter 45 so that the user's attention is directed to the location of the filter when the graphics are illuminated. The term graphics, as used herein, is meant to mean something other than the illumination source itself.

The illumination from the illuminating component 112 may be directed to an outer surface of the graphics 118, or the graphics may be light transmissive so that the illumination can be directed to a back side of the graphics, and transmitted therethrough to the exterior surface 116 of the cap 104.

In an embodiment, the cap 104 may comprise a pair of co-injected molded plastic parts 120, 122, with the light pipe 114 being a light transmissive one of the plastic parts being co-injected and an opaque plastic part being another of the plastic parts being co-injected.

The control 106 may be mounted remotely from the filter 45, such as at the control console 60, or the control may be mounted directly on the filter body 100. In an embodiment, the control 106 includes an electronics mechanism for determining a remaining life for the filter cartridge. The control 106 and the illuminating component 112 may be powered by a domestic AC power supply, such as that used to power the refrigerator 10, or the control or the illuminating component may be powered by a battery 124 to avoid the necessity of running power lines to these components.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. An indicator for a refrigerator filter comprising:

a body having a fluid inlet and a fluid outlet with a fluid path therebetween and configured to contain a replaceable filter cartridge in the fluid path and including a cap arranged to enclose the filter cartridge within the body and to be removable from the body to permit a removal and replacement of the filter cartridge;

a control having a filter life determination mechanism and arranged to emit a life expiration signal only when a life of the filter cartridge is determined to be expired; and a visual display arranged in association with the body which comprises:

an illuminating component mounted away from the cap and fixed relative to the body which illuminates only upon receipt of the signal from the control;

a light pipe at least partially carried on the removable cap and extending towards the illuminating component to transmit light from the illuminating component to the cap; and permanent graphics arranged on the cap so as to be illuminated by the illuminating component via the light pipe which graphics are visible on the exterior surface of the cap.

2. An indicator according to claim 1, wherein the illuminating component comprises an LED.

3. An indicator according to claim 1, wherein the graphics comprise a pre-written instruction to a user to replace the filter cartridge.

4. An indicator according to claim 1, wherein the cap is a co-injected molded plastic part, with one plastic material being light transmissive.

5. An indicator according to claim 1, wherein the indicator includes a second visual display operated by the control providing a user with an indication of the remaining life of the filter cartridge.

6. An indicator according to claim 1, wherein the control includes an electronics mechanism for determining a remaining life for the filter cartridge.

7. An indicator according to claim 1, wherein the visual display is powered by a battery.

8. An indicator according to claim 1, wherein the control is located on the body.

9. An indicator according to claim 1, wherein the filter cartridge is a water filter.

10. An indicator according to claim 1, wherein the filter cartridge is an air filter.

11. An indicator according to claim 1, wherein the cap comprises a pair of co-injected molded plastic parts, with the light pipe being one of the plastic parts being co-injected and an opaque plastic part being another of the plastic parts being co-injected.

12. A refrigerator including a filter indicator comprising:

a cabinet;

a body having a fluid inlet and a fluid outlet with a fluid path therebetween mounted in the cabinet and configured to contain a replaceable filter cartridge and including an openable cap arranged to enclose the filter cartridge within the body when closed and, when moved to an open position, to permit a removal and replacement of the filter cartridge;

a control having a filter life determination mechanism and arranged to emit a life expiration signal only when a life of the filter cartridge is determined to be expired; and a visual display associated with the body which comprises:

an illuminating component mounted away from the cap and fixed relative to the body which illuminates only upon receipt of the signal from the control;

permanent graphics positioned on the openable cap; and a light pipe at least partially carried on the cap and extending from the graphics towards the illuminating component to transmit light from the illuminating component to the graphics.

13. A refrigerator according to claim 12, wherein the illuminating component comprises an LED.

14. A refrigerator according to claim 12, wherein the graphics comprise a pre-written instruction to a user to replace the filter cartridge.

15. A refrigerator according to claim 12, wherein the cap is a co-injected molded plastic part, with one plastic material being light transmissive.

16. A refrigerator according to claim 12, wherein the indicator includes a second visual display located in the cabinet remote from the body and operated by the control providing a user with an indication of the remaining life of the filter cartridge.

17. A refrigerator according to claim 12, wherein the visual display is powered by a battery.

18. A refrigerator according to claim 12, wherein the control is located on the body.

19. A refrigerator according to claim 12, wherein the filter cartridge is a water filter.

20. A refrigerator according to claim 12, wherein the filter cartridge is an air filter.

21. A refrigerator including a filter indicator comprising:

a cabinet;

a body having a fluid inlet and a fluid outlet and defining a fluid path therethrough mounted in the cabinet configured to contain a replaceable filter cartridge positioned in the fluid path and including an openable cap to enclose the filter cartridge within the body, the cap being movable relative to the body between a closed position and an open position to permit removal and replacement of the filter cartridge;

a control having a filter life determination mechanism and arranged to emit a life expiration signal only when a life of the filter cartridge is determined to be expired; and a visual display associated with the body which comprises:

an illuminating component mounted in a fixed manner relative to the body and spaced from the openable cap which illuminates only upon receipt of the signal from the control;

permanent graphics being light transmissive and having a front portion forming a portion of an exposed surface of the openable cap; and a light pipe extending from a rear portion of the graphics towards the illuminating component to transmit light from the illuminating component to the rear portion of the graphics while the openable cap is in the closed position.

22. A refrigerator according to claim 21, wherein the cap is completely removable.

23. A refrigerator according to claim 21, wherein the cap forms an opaque portion and a light transmissive portion, the light transmissive portion being the graphics.

* * * * *